US005657637A

United States Patent [19]

Mertens

[11] Patent Number: 5,657,637

[45] Date of Patent: Aug. 19, 1997

[54] ASSEMBLY FOR TEMPERATURE CONTROL OF A FOUNTAIN FLUID AND/OR SELECTED ROLLS OF A PRINTING PRESS

[75] Inventor: Heinz Mertens, Beelen, Germany

[73] Assignee: Technotrans GmbH, Sassenberg, Germany

[21] Appl. No.: 559,145

[22] Filed: Nov. 17, 1995

[30] Foreign Application Priority Data

Nov. 25, 1994 [DE] Germany ..... 44 42 072.2

[51] Int. Cl.[6] ..... F25D 17/02

[52] U.S. Cl. ..... 62/175; 62/201; 62/196.3; 62/228.4; 62/217

[58] Field of Search ..... 62/175, 510, 197, 62/217, 199, 185, 201, 200, 228.4, 228.5, 196.1, 196.3

[56] References Cited

U.S. PATENT DOCUMENTS

| | | | |
|---|---|---|---|
| 1,749,316 | 3/1930 | Catlin . | |
| 2,022,635 | 11/1935 | Durham . | |
| 2,363,273 | 11/1944 | Waterfill | 62/196.3 X |
| 3,318,018 | 5/1967 | Steele et al. . | |
| 4,389,855 | 6/1983 | Ueda et al. | 62/217 X |
| 4,658,596 | 4/1987 | Kuwahara | 62/228.4 X |
| 5,035,119 | 7/1991 | Alsenz | 62/228.5 X |

FOREIGN PATENT DOCUMENTS

| | | |
|---|---|---|
| 0 602 312 A1 | 6/1994 | European Pat. Off. . |
| 58-62053 | 4/1983 | Japan . |
| 58-62055 | 4/1983 | Japan . |
| 58-62056 | 4/1983 | Japan . |
| 1-72846 | 3/1989 | Japan . |
| 1-72847 | 3/1989 | Japan . |
| 1-72848 | 3/1989 | Japan . |
| 115970 | 5/1918 | United Kingdom . |

*Primary Examiner*—Harry B. Tanner
*Attorney, Agent, or Firm*—Griffin, Butler, Whisenhunt & Kurtossy

[57] ABSTRACT

An assembly for temperature control of a fountain (dampening) fluid and/or selected rolls of a printing press, comprising a first open-circuit circulating system ($U_I$) for supplying a fountain fluid application mechanism with a fountain fluid from a fountain fluid reservoir and a second closed-circuit circulating system ($U_{II}$) for supplying a roll cooling mechanism with a cooling fluid. Each circulating system ($U_I$, $U_{II}$) is assigned a heat exchanger (3,4). The heat exchangers (3,4) receive refrigerant from a refrigeration mechanism having a power-switchable compressor (10) including a refrigerant return, thus enabling a refrigeration output to be adapted to demands in selectable operating modes "fountain-fluid cooling only", "cooling-fluid cooling only" or "fountain-fluid and cooling-fluid cooling".

8 Claims, 2 Drawing Sheets

ASSEMBLY FOR TEMPERATURE CONTROL OF A FOUNTAIN FLUID AND/OR SELECTED ROLLS OF A PRINTING PRESS

BACKGROUND OF THE INVENTION

The invention relates to an assembly for temperature control of a fountain (dampening) fluid and/or selected rolls of a printing press. The invention thus concerns in general the field of offset printing.

In a know assembly (EP-A-0 602 312) each of circulating systems for a fountain fluid and for a cooling fluid for supplying a roll cooling device is configured as an open-circuit system, with each circulating system being assigned a reservoir, serving as a buffer storage for the respective fluids of the systems. In this known assembly the reservoir connected to the open-circuit system for circulating the cooling fluid is necessary, since a refrigeration mechanism supplying a heat exchanger mechanism of the circulating systems with refrigerant is designed for a maximum capacity necessary. This means that in an offset printing shop having no cooling of the fountain fluid, the heat exchanger mechanism for the cooling fluid circulating system receives a maximum supply of refrigeration energy which could result in the cooling fluid being excessively cooled, if—as is the case in a closed-circuit system—an amount of cooling fluid available is not sufficient to absorb excess refrigeration energy. In other words, in the known temperature control assembly the reservoir intercepts part of the excess refrigeration energy. Attempting to eliminate the reservoir would necessitate having to repeatedly switch ON/OFF compressor designed for maximum refrigerating capacity to restrict its refrigeration output. This is practically impossible to implement for the short switching cycles which would then be required, since compressors need a certain minimum continuous running time, otherwise there would be a risk of damage with early failure of the compressor. A further drawback of the known assembly is that it has an increased energy demand, since the refrigeration mechanism always needs to be operated at full power, irrespective of a refrigeration output actually provided in each phase of operation.

There is thus a need for an assembly of the kind described above which is improved with regard to at least one of: "system complexity", "energy consumption" or "operating behavior".

SUMMARY

According to principles of this invention a cooling fluid circulating system of a temperature control system is configured as a closed-circuit system in combination with a refrigeration mechanism, a refrigeration output of which can be selectively switched without detracting from the functioning and life of a compressor. This arrangement enables the refrigeration output to be tailored to an actual demand of a heat exchanger mechanism in each case for a one of at least two circulating systems; and in particular, excessive loading of one heat exchanger mechanism with refrigeration energy may be effectively avoided. The cooling fluid circulating system thus requires no buffer storage in the form of a reservoir for intermediate storage of excess amounts of cooling fluid, but may now be configured as a closed-circuit circulating system. This not only substantially improves operating behavior of the temperature control system as a whole, due to contaminations of the cooling fluid being naturally avoided, it also reduces system complexity, thereby saving costs, since there is now no need for a cooling fluid reservoir. By contrast, a slightly increased expense in configuring the refrigeration mechanism is hardly felt, especially since an assembly according to the invention also enables significant primary energy savings.

BRIEF DESCRIPTION OF THE DRAWINGS

The invention will now be detailed on the basis of embodiments with reference to the drawings, in which.

DESCRIPTION OF THE PREFERRED EMBODIMENT

Figure 1:
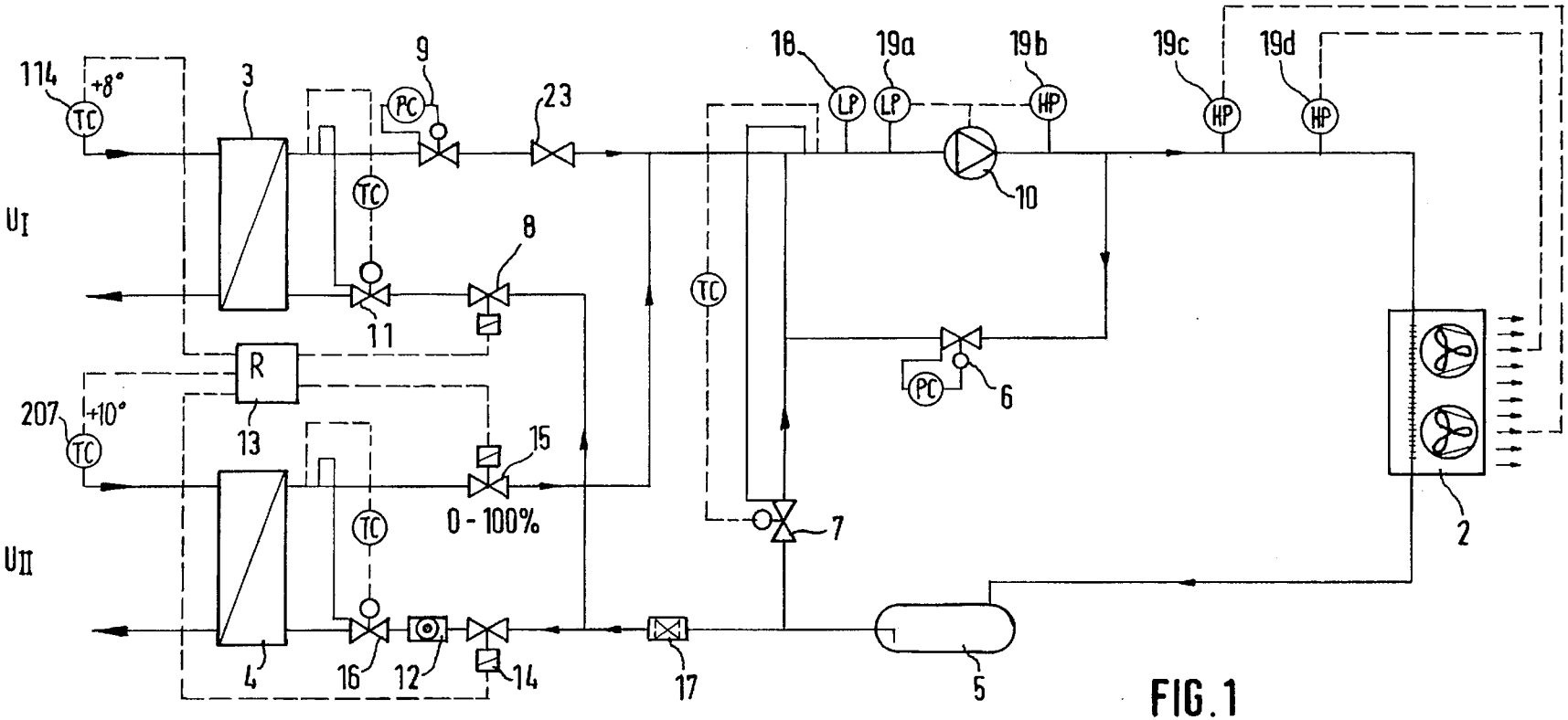
FIG. 1 is a circuit diagram of a refrigeration mechanism in accordance with a first embodiment of the invention, indicating a circulating system for a fountain (dampening) fluid and for a cooling fluid.

In the drawing, mechanisms on A printing press supplied with fountain (dampening) fluid and/or cooling fluid, i.e. systems for applying the fountain fluid to rolls and cooling mechanisms for e.g. inking rolls or other selected rolls of the printing press are omitted. Such mechanisms are known in general to persons skilled in the art and therefore require no further explanation in this context.

In FIG. 1 showing a first embodiment of the invention, a compressor, e.g. a reciprocating piston compressor, is identified by the reference numeral 10 which may be selectively switched from a maximum rotary speed to a reduced rotary speed, so that the power output of the compressor 10 may be switched correspondingly between full load and part load operation. The output of the compressor 10 connects to a condenser 2 in which the refrigerant is translated from its vapor phase into its liquid phase. The liquid refrigerant at the output of condenser 2 is introduced into a refrigerant receiver 5, serving as a storage.

An output of the refrigerant receiver 5 is connected to inputs of first and second heat exchanger mechanism 3, 4. The first heat exchanger mechanism 3 is part of a fountain (dampening) fluid circulating system indicated by U, which may be an open-circuit system having a reservoir (not shown) for holding a sufficient amount of fountain fluid. The second heat exchanger mechanism 4 is part of a closed-circuit cooling fluid circulating system indicated by $U_{II}$ for supplying a roll cooling mechanism (also not shown).

In particular, an output of the receiver 5 is connected at the one end to an input of the first heat exchanger mechanism 3 via a shutoff valve 8 and an expansion valve 11 and, at the other end, to an input of the second heat exchanger mechanism 4 via a shutoff valve 14 and an expansion valve 16.

Via an evaporation pressure control valve 9 and a non-return valve 23, preventing flow in a direction of output of the heat exchanger mechanism 3 and permitting flow in an opposite direction, an output of the first heat exchanger mechanism 3 is connected to an input of the compressor 10, while an output of the second heat exchanger mechanism 4 is connected to the input of compressor 10 via a flow control valve 15 detained in the following.

The shutoff valves 8 and 14, both of which may be solenoid valves, as well as the flow control valve 15 are actuated as a function of a control mechanism 13, the input signals of which are signals it receives from measurement sensors 114, 207 for sensing a temperature of a medium flowing into the circulating systems U, and $U_{II}$ on supply sides of the heat exchanger mechanism 3 and 4 respectively.

The expansion valves 11 and 16 are controlled as a function of a temperature of refrigerant at the outputs of the heat exchanger mechanism 3 and 4 respectively.

In a connection between the output of the first heat exchanger mechanism 3 and the input of the compressor 10 the evaporation pressure control valve 9 may be provided, which prevents an evaporation pressure in the heat exchanger mechanism 3 from dropping below a critical minimum value.

A bypass arrangement is provided to return part of the gaseous refrigerant at the output of the compressor 10 back to the input end thereof. A pressure sensing valve 6 in this return conduit has the task of ensuring an adequate flow of refrigerant through the compressor 10, irrespective of an operating status of the compressor 10 (full or part load operation) at any time. Especially in part-load operation, a lack of returned refrigerant would otherwise result in an insufficient flow of refrigerant through the compressor 10, so that the latter would no longer be adequately cooled and damage to the compressor 10 could be involved. Pressure sensors 19*a* and 19*b* sense pressures of the refrigerant at the input and output ends of the compressor 10 respectively, to shut off the latter should the pressure at the input end be inadequate or should it be excessive at the output end, again to prevent damage to the compressor, as would otherwise materialize, should critical minimum and maximum pressure values be violated.

Hot gaseous refrigerant returned to the input of the compressor 10 would cause the compressor to overheat. To prevent this happening, an injection valve 7 for cooling the returned refrigerant is provided to inject liquid refrigerant into the gaseous output of the pressure sensing valve 6, so that the gaseous output of the pressure sensing valve 6 may be reduced to a temperature sufficient to prevent damage of the compressor 10. This injection valve 7 is connected to the output of the receiver 5 and receives an actuating signals for setting an amount of refrigerant injected from a temperature sensor at the input of the compressor 10. A pressure switch 18 at the input end of the compressor 10 is provided to switch the compressor 10 from full load to part-load operation before the pressure sensing valve 6 opens.

Pressure switches 19*c* and 19*d* at the input of the condenser 2 supply control signals to a pair of condenser blowers for selectively switching the latter ON/OFF, depending on the pressure of the gaseous refrigerant, and to maintain pressure conditions in the refrigerant circuit constant, despite differing ambient temperatures.

The flow control valve 15 provided at the output of the second heat exchanger mechanism 4 for the cooling fluid circulating system $U_{II}$, i.e. for the system having a refrigeration energy demand higher than that of the fountain fluid circulating system $U_I$, permits infinitely variable control of refrigerant flow through the heat exchanger 4 and thus adjustment of refrigeration energy supplied to the heat exchanger 4 between 0 and a maximum value, e.g. 100%. At the same time, in the 0 position, the flow control valve 15 takes on a function of a shutoff valve. In addition, the flow control valve 15 may be set via the control mechanism 13 to an upper critical limit of the refrigeration energy supplied to the second heat exchanger mechanism 4, if, apart from this, a further supply of refrigeration energy is needed for the first heat exchanger mechanism 3 of the fountain fluid circulating system $U_I$. Due to the higher refrigeration energy demand of the cooling fluid circulating system $U_{II}$, the flow control valve 15 may be set—at the same time as the fountain fluid circulating system U, is set e.g. to a critical limit of two-thirds of the total refrigerating output of the compressor 10—to ensure that a third of the total output is available for supplying the first heat exchanger mechanism 3, irrespective of the demand of the cooling fluid circulating system $U_{II}$.

At the inputs of the heat exchanger mechanism 3 and 4, reference numerals 12 identify inspection glasses permitting a visual inspection of the refrigerant flow to the heat exchanger mechanisms 3, 4. Reference numeral 17 identifies a filter at the output of the receiver 5 for filtering out aqueous constituents from the refrigerant.

The assembly configured as described above operates as follows:

Mode: Cooling The Fountain Fluid Only

In this mode the shutoff valve 14 at the input of the second heat exchanger mechanism 4 for the cooling fluid circulating system $U_{II}$ is in a closed position, and also the flow control valve 15 is set to the position 0 refrigerant flow, so that no refrigerant is able to flow through the heat exchanger mechanism 4. A reduced refrigeration demand of the first heat exchanger mechanism 3 of the fountain fluid circulating system U, is taken into account, by the compressor 10 being selectively switched to part-load operation (e.g. 50% of maximum output), in that a rotary speed of the compressor 10 is reduced accordingly.

The pressure sensing valve 6 in the return conduit thus opens so that part of the gaseous refrigerant at the output of the compressor 10 is able to flow back to its input. In accordance with the temperature of the refrigerant at the input of the compressor 10 the injection valve 7 is controlled to reduce the temperature to a value permissible for the compressor 10. For a refrigeration demand of the first heat exchanger mechanism 3 of e.g. one-third of the maximum refrigeration output, e.g. 10% of the output of the compressor 10 may be branched off and returned to the input of the compressor.

Mode: Cooling The Cooling Fluid Only

The shutoff valve 14 at the input of the second heat exchanger mechanism 4 is opened and the flow control valve 15 is set to a refrigerant flow between 0 and 100% corresponding to the temperature of the cooling fluid supplied to the heat exchanger mechanism 4.

The shutoff valve 8 at the input of the first heat exchanger mechanism 3 is closed so that refrigerant is supplied only to the second heat exchanger mechanism 4. Under these circumstances the compressor 10 can operates at full or part load, according to the refrigeration energy demand of the second heat exchanger mechanism 4, depending on the refrigeration output between 0 and 100% dictated by the flow control valve 15.

In part-load operation of the compressor 10 the refrigerant return is the same as described for the circumstances in conjunction with the mode "Cooling the fountain fluid only".

The non-return valve 23 at the output of the first heat exchanger mechanism 3 prevents in this mode a flow of refrigerant from the output of the second heat exchanger mechanism 4 to the output of the first heat exchanger mechanism 3.

Mode: Cooling Fountain Fluid and Cooling Fluid

The shutoff valves 14 and 8 at the inputs of the heat exchanger mechanisms 3 and 4 respectively are open, and the flow control valve 15 at the output of the second heat exchanger mechanism 4 is set by the control mechanism 13 to a maximum refrigeration output corresponding to two-thirds of the total refrigeration capacity of the refrigeration mechanism, so that the refrigeration output applicable to the second heat exchanger mechanism 4 is limited to a range e.g. between 0 and approx. 66%. The remainder of the total refrigeration capacity is thus always available for supplying the first heat exchanger mechanism 3, irrespective of the demand of the second heat exchanger mechanism 4.

In accordance with the refrigeration demand of the heat exchanger mechanisms 3, 4, the compressor 10 is switched between full and part load operation, in the latter mode of operation a return of refrigerant being possible analogous to the mode "fountain fluid cooling only". Once the set point temperature of the cooling fluid is achieved, as sensed by the sensor 207, the shutoff valve 14 switches the refrigerant flow through the second heat exchanger mechanism 4 OFF, or permits such a flow of refrigerant as soon as the prescribed cooling fluid temperature is exceeded, the compressor 10 then operating under part or full load in accordance with the refrigeration demand of the first heat exchanger mechanism 3 existing at the time.

The invention thus permits the refrigeration output of the compressor 10 to be effectively adapted to operating conditions in each case. This ensures an energy supply to the second heat exchanger mechanism 4, tailored to meet the demand of the cooling fluid circulating system $U_{II}$ in the various operating modes, so that an excessive energy supply to the heat exchanger mechanism 4 is avoided. Accordingly, the cooling fluid circulating system $U_{II}$ is configurable as a closed-circuit system, since there is no need for an energy buffer storage in the form of a cooling fluid reservoir.

The above description of the invention is based on an assembly including a refrigeration system comprising only a single power-switchable compressor. Instead of this, also two or more compressors connected in parallel could be provided, each of which need not be power-switchable, but instead may be switched ON/OFF in accordance with an energy demand in each case, so that a MAX or MIN refrigeration output is available accordingly at a common output of the compressor. Returning gaseous refrigerant from the common output to a common input of the compressors connected in parallel may then be arranged analogously to the situation of the refrigeration mechanism described above.

Figure 2:
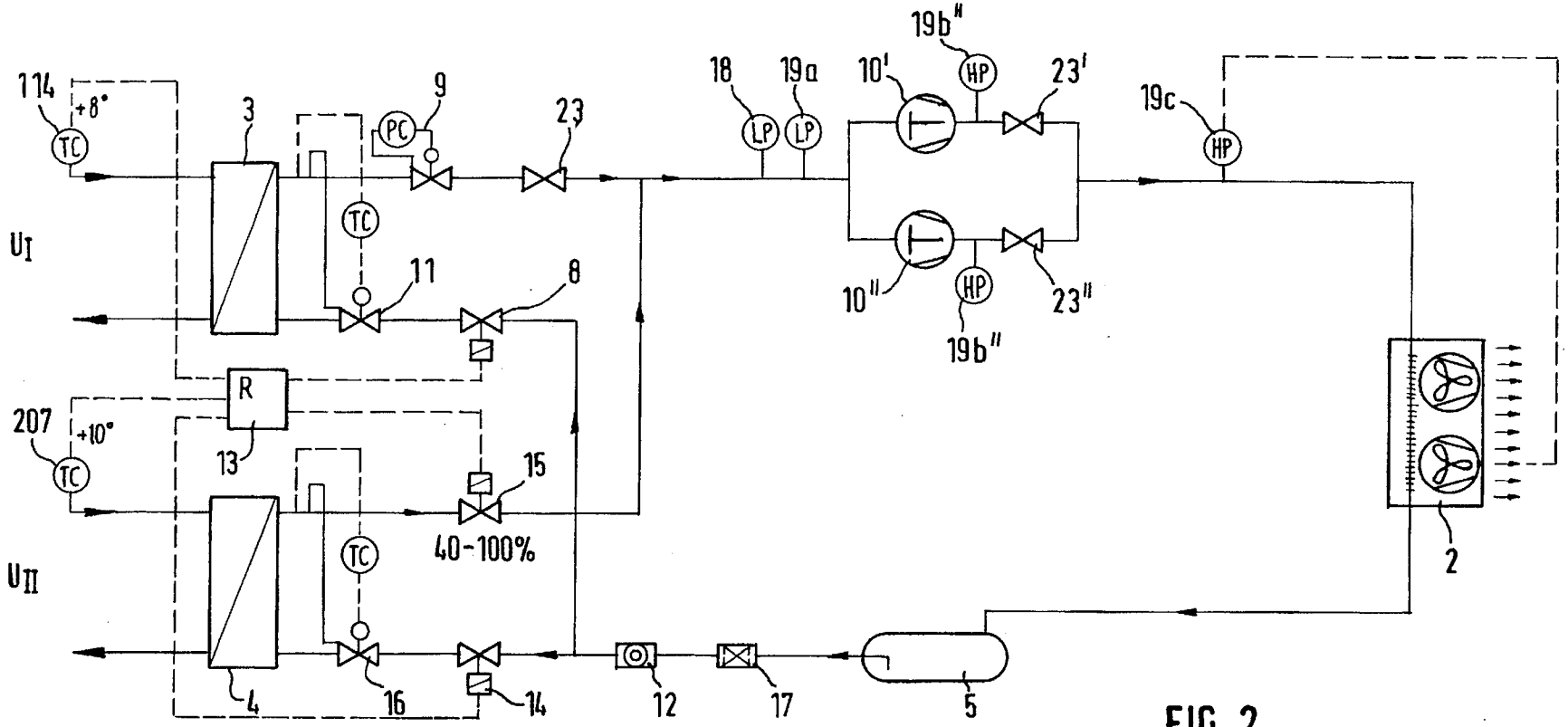
FIG. 2 is a view similar to FIG. 1 of a circuit diagram of a refrigeration mechanism in accordance with a second embodiment of the invention.

FIG. 2 shows the second embodiment of the invention which differs from the already described embodiment shown in FIG. 1 in that the refrigerant return bypass conduit containing the pressure sensing valve 6 is omitted and the setting range of the flow control valve 15 is limited between a maximum value of 100% and a minimum value which is substantially greater than 0%, e.g. 40%. In the embodiment according to FIG. 2 the mechanism for injecting a liquid refrigerant into returned refrigerant for cooling are also omitted. Thus, the embodiment as shown in FIG. 2 features fewer components, enabling expenses of assembly and maintenance to be reduced and better cost-effective operation to be achieved.

Otherwise, the embodiment of the invention as shown in FIG. 2 may be configured the same as that shown in FIG. 1. Preferably, however, instead of only one power-switchable compressor, a pair of compressors 10', 10" is provided connected in parallel, designed so that each of them may furnish a fraction, e.g. 50% of the refrigeration output required as a whole. Each compressor 10', 10" is assigned a non-return valve 23' and 23" respectively in series at the output end. The outputs of the non-return valves 23', 23" are connected via a common connecting conduit to the input of the condenser 2.

Accordingly, by switching one of the compressors 10-, 10" OFF and setting the flow control valve 15 to a minimum value of e.g. 40%, the total refrigeration output furnished by the refrigeration system may be adjusted infinitely variably between 20 and 100% by the flow control valve 15. Overheating of the compressors 10', 10" in the "cooling the cooling fluid" mode, i.e. with the shutoff valve 16 open, is prevented by limiting the adjustment range of the flow control valve 15 to a minimum value which is substantially higher than 0%, so that a certain flow of refrigerant may always be discharged in the direction of the compressors 10', 10".

The refrigeration system constitutes preferably a separate assembly having integrated heat exchanger mechanism 3, 4 and feed and discharge ports for fountain fluid and cooling fluid circulating systems to be connected thereto.

Although the invention has been described on the basis of preferred embodiments, it will be appreciated that any modifications apparent to a person skilled in the art from the disclosure do not mean a departure from the concept according to the invention.

What is claimed is:

1. An assembly for controlling temperature of a fountain fluid and of selected rolls of a printing press, comprising:

a fountain-fluid circulating system for supplying a fountain-fluid reservoir;

a cooling-fluid circulating system for supplying a roller-cooling mechanism with cooling fluid;

each of said fountain-fluid and cooling-fluid circulating systems including a respective fountain-fluid and cooling fluid heat exchanging means for respectively exchanging heat between a refrigerant and the respective fountain fluid and cooling fluid in said fountain-fluid and cooling-fluid circulating systems;

a refrigeration means, including a refrigerant circulating system, for supplying each of said fountain-fluid and cooling-fluid heat exchanging means with said refrigerant, said refrigerant flowing into refrigerant inputs and out of refrigerant outputs of said respective fountain-fluid and cooling-fluid heat exchanging means; and a means for selectively operating said fountain-fluid and cooling-fluid circulating systems individually and simultaneously;

wherein said refrigerant circulating system is a closed-circuit system including a compressor means for driving said refrigerant therein, said compressor means being switchable between maximum and minimum outputs;

and wherein a flow control valve is included between said refrigerant output of the cooling-fluid heat exchanging means and an input of said compressor means for controlling refrigerant flow for controlling, in an infinitely variable manner, refrigeration output to the cooling-fluid heat exchanging means between minimum and maximum levels.

2. An assembly as in claim 1 wherein said compressor means comprises a power-switchable compressor with an output thereof being connected to its own input via a return conduit including a pressure sensing valve, and wherein said flow control valve is setable for controlling a flow rate therethrough in a range between 0 and 100%.

3. An assembly as in claim 2, wherein, when both said cooling-fluid and fountain-fluid circulating systems are operated, the flow control valve is set for limiting refrigeration output applied to the cooling-fluid heat exchanging means to a range ≦two-thirds of a total refrigeration output of said refrigeration means.

4. An assembly as in claim 2, wherein said compressor is speed-switchable.

5. An assembly as in claim 2, including an injecting means for injecting a quantity of liquid refrigerant into an output of said pressure sensing valve as a function of a temperature of the refrigerant at the input of said compressor for reducing the temperature of the refrigerant at the input of said compressor.

6. An assembly in claim 1, wherein said compressor means comprises at least two compressors connected in parallel, with each being switchable ON/OFF, individual refrigeration outputs of each compressor being smaller than a desired total refrigeration output, and wherein said flow control valve is set to limit a flow rate therethrough to a range between>>0 and≦100%.

7. An assembly as in claim 6, wherein when both said cooling-fluid and fountain-fluid circulating systems are operated, the flow control valve is set for limiting refrigeration output to the cooling-fluid heat exchanging means to a range≦two-thirds of a total refrigeration output of said refrigeration means.

8. An assembly as in claim 1, wherein said compressor means comprises at least two compressors connected in parallel with each being switchable ON/OFF, individual refrigeration outputs of each compressor being smaller than a desired total refrigeration output, and wherein said flow control valve is set to limit a flow rate therethrough to a range between about 40 and ≦100%.

* * * * *